US007735975B2

(12) United States Patent
Endo et al.

(10) Patent No.: US 7,735,975 B2
(45) Date of Patent: Jun. 15, 2010

(54) LIQUID EJECTING APPARATUS, RECORDING APPARATUS, AND FIELD GENERATING UNIT

(75) Inventors: Tsunenobu Endo, Nagano-Ken (JP); Tomoaki Takahashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 614 days.

(21) Appl. No.: 11/585,574

(22) Filed: Oct. 23, 2006

(65) Prior Publication Data

US 2007/0091146 A1 Apr. 26, 2007

(30) Foreign Application Priority Data

Oct. 26, 2005 (JP) ..... 2005-311950
Oct. 26, 2005 (JP) ..... 2005-311951

(51) Int. Cl.
*B41J 2/045* (2006.01)

(52) U.S. Cl. ..... 347/68

(58) Field of Classification Search ..... 347/54–57, 347/61, 44–47, 40, 42, 20, 12, 13
See application file for complete search history.

(56) References Cited

U.S. PATENT DOCUMENTS 6,097,408 A 8/2000 Fukushima et al.

FOREIGN PATENT DOCUMENTS

| | | | |
|---|---|---|---|
| EP | 0 437 062 | A2 | 7/1991 |
| EP | 0473178 | B1 | 4/1992 |
| EP | 0 832 742 | B1 | 4/1998 |
| EP | 1 693 217 | A2 | 8/2006 |
| GB | 2 324 765 | A | 11/1998 |
| JP | 2 184450 | A | 7/1990 |
| JP | 4294149 | A | 10/1992 |
| JP | 5104724 | A | 4/1993 |
| JP | 2005-186290 | | 7/2005 |
| JP | 2005254826 | A | 9/2005 |
| WO | WO-95/11807 | A1 | 5/1995 |

OTHER PUBLICATIONS

European Search Report dated Feb. 5, 2007—EP 06 02 2307.

*Primary Examiner*—Kristal J. Feggins
(74) *Attorney, Agent, or Firm*—Nutter McClennen & Fish LLP; John J. Penny, V.; Michael P. Visconti, III

(57) ABSTRACT

There is provided a liquid ejecting apparatus including a liquid ejecting head that ejects liquid from an aperture of a nozzle plate toward a recording material while reciprocating over the recording material and a platen that supports the recording material from a rear face thereof to position the recording material at a position facing the nozzle plate in a direction in which the liquid is ejected. The liquid ejecting apparatus further includes: a first electrode being provided on the platen side between the liquid ejecting head and the platen; a second electrode being provided on the liquid ejecting head side between the liquid ejecting head and the platen; and a potential difference generating section of which one end is connected to the first electrode and the other end is connected to the second electrode and that generates a potential difference between the second electrode and the first electrode.

15 Claims, 11 Drawing Sheets

LIQUID EJECTING APPARATUS, RECORDING APPARATUS, AND FIELD GENERATING UNIT

CROSS REFERENCE TO RELATED APPLICATIONS

This patent application claims priority from Japanese Patent Applications Nos.: 2005-311950 and 2005-311951 both filed in JP on Oct. 26, 2005, the contents of which are incorporated herein by reference.

BACKGROUND

1. Field of the Invention

The present invention relates to a liquid ejecting apparatus, a recording apparatus, and a field generating unit. More particularly, the present invention relates to a liquid ejecting apparatus and a recording apparatus for attaching liquid discharged from an aperture of a nozzle plate mounted on a liquid ejecting head to a recording material, and a field generating unit capable of being used in these apparatuses.

2. Related Art

In a liquid ejecting apparatus, according to the demand for resolution improvement of a recording image, a droplet discharged from an aperture of a nozzle plate in a current liquid ejecting apparatus is miniaturized up to about several pl or pico-litter. Since such a minute droplet has extremely small mass, kinetic energy is rapidly lost by viscous resistances of an atmosphere once the droplet is discharged. Specifically, the speed of droplet becomes substantially zero, for example, when a droplet less than 3 pl flies a distance of about 3 mm in the atmosphere. Since a falling motion by acceleration of gravity and a viscous resistance force of an atmosphere are nearly balanced in a minute droplet of which kinetic energy is lost, it takes a long time to fall completely.

Moreover, in order to give larger kinetic energy to a droplet, it is also possible to raise jet velocity of liquid ejected from a liquid ejecting head. However, when actually increasing jet velocity from the nozzle plate, it is easy to produce an extremely minute droplet referred to as an ink mist when a droplet leaves the nozzle plate. Moreover, since viscous resistance of an atmosphere acting on each droplet becomes still larger, it is found that a travel distance of the droplet shortens rather than that of a droplet before increasing jet velocity.

A floating droplet produced as a result of various phenomena as described above is referred to as an aerosol, and floats in the vicinity of a traveling area of the liquid ejecting head. A part of aerosols floats up to an outside of the liquid ejecting apparatus, and thus adheres to the vicinity of the liquid ejecting apparatus to deface the apparatus. Moreover, most of aerosols adhere to each portion within the liquid ejecting apparatus before long. Particularly, when aerosols adhere on a carrying path of a recording material such as a platen, a recording material to be next carried is polluted. Moreover, when aerosols adhere to an electric circuit, a rotary scale, a linear scale, or various types of optical sensors of the liquid ejecting apparatus, this may cause malfunction of the apparatus. Furthermore, when a user touches a portion to which aerosols adhere, a hand of the user is polluted.

A liquid ejecting apparatus described in the following Japanese Patent Application Publication 2005-186290 forms an electric field between a nozzle plate and a matter to be processed to make Coulomb force facing the matter act on a droplet. In this way, it is described to make the droplet surely arrive at the matter to prevent the generation of aerosols. Moreover, Japanese Patent Application Publication 2005-186290 proposes that electrification of a matter to be processed caused by attaching the charged liquid to the matter is prevented by reversing the polarity of voltage to be applied to the matter.

However, the configuration disclosed in Japanese Patent Application Publication 2005-186290 includes, as essential components, a switching means for reversing the polarity of applied voltage, a control means for measuring a timing of switching, or the like, in addition to a voltage applying means for applying a voltage to a matter to be processed. Therefore, the magnitude and manufacturing cost of the liquid ejecting apparatus just have to be raised in order to realize a configuration as described in Japanese Patent Application Publication 2005-186290.

SUMMARY

Therefore, it is an object of some aspects of the present invention to provide a liquid ejecting apparatus, a recording apparatus, and a field generating unit that can solve the foregoing problems. The above and other objects can be achieved by combinations described in the independent claims. The dependent claims define further advantageous and exemplary combinations of the present invention.

To solve this problem, according to the first aspect of the present invention, there is provided a liquid ejecting apparatus including a liquid ejecting head that has a nozzle plate and ejects liquid from an aperture of the nozzle plate toward a recording material while reciprocating over the recording material and a platen that supports the recording material from a rear face thereof to position the recording material at a position facing the nozzle plate in a direction in which the liquid is ejected. The liquid ejecting apparatus includes: a first electrode being provided on the platen side between the liquid ejecting head and the platen; a second electrode being provided on the liquid ejecting head side between the liquid ejecting head and the platen; and a potential difference generating section of which one end is connected to the first electrode and the other end is connected to the second electrode and that generates a potential difference between the second electrode and the first electrode.

The potential difference generating section may constantly keep a potential difference between the second electrode and the first electrode.

The second electrode may be a conductive nozzle plate and the first electrode may be electrically coupled to the recording material supported on the platen. Moreover, the liquid ejecting apparatus may generate an electric field between the nozzle plate and the recording material on the platen to electrically attract liquid ejected from the aperture of the nozzle plate toward the recording material. In this way, an electric field is formed between the nozzle plate and the recording material. In this way, since the ejected droplet surely arrives at the recording material, the generation of aerosols is prevented. Moreover, a potential difference between the nozzle plate and the recording material generating this electric field is constantly kept by the potential difference generating section. Therefore, since the electric field is constantly kept even if the charged liquid adheres to the recording material, it is not necessary to provide a switching means of an applied voltage or a control means for controlling a switching timing.

Moreover, in the liquid ejecting apparatus, the first electrode may be mounted on the platen, and be electrically coupled to the recording material supported on the platen.

Moreover, in the liquid ejecting apparatus, the first electrode may include a conductive member mounted on a part in the platen abutting on the rear face of the recording material.

In this way, since the first electrode touches the recording material right under the nozzle plate to control the potential, it is possible to efficiently control electric potential of the recording material.

Moreover, in the liquid ejecting apparatus, the first electrode may include a conductive member mounted through the platen in a direction in which the liquid is ejected, and one end of the first electrode may be in contact with the recording material and the other end may be electrically connected to the potential difference generating section. In this way, wiring for connecting the first electrode to the potential difference generating section can be performed in the rear face of the platen. Therefore, the layout in the liquid ejecting apparatus becomes easy.

Moreover, in the liquid ejecting apparatus, the first electrode may include a conductive member being in contact with the recording material on at least one side of just before and just after the platen on a carrying path of the recording material. In this way, it is possible to select an arbitrary place and an arbitrary material to form the first electrode.

Moreover, the liquid ejecting apparatus may further include: a carrying portion that includes a rotationally driven carrier driving roller and a carrier driven roller rotated with the rotation of the carrier driving roller while pressing the recording material on the carrier driving roller and sends the recording material onto the platen; and a discharging portion that includes a rotationally driven discharge driving roller and a discharge driven roller rotated with the rotation of the discharge driving roller while pressing the recording material on the discharge driving roller and sends away the recording material from the top of the platen, at least one of the carrier driving roller, the carrier driven roller, the discharge driving roller, and the discharge driven roller may be a conductive roller formed of a conductive material, and the conductive roller may be electrically coupled to the recording material as the first electrode. In this way, the electric field is formed between the nozzle plate and the recording material. In this way, since the ejected droplet surely arrives at the recording material, the generation of aerosols is prevented. Moreover, a potential difference between the nozzle plate and the recording material generating this electric field is constantly kept by the potential difference generating section. Therefore, since the electric field is constantly kept even if the charged liquid adheres to the recording material, it is not necessary to provide a switching means of an applied voltage or a control means controlling a switching timing.

Moreover, in the liquid ejecting apparatus, the carrier driving roller and the discharge driving roller may be the conductive roller. In this way, since the recording material is coupled to the potential difference generating section just before and just after the platen, the electric potential of the recording material on the platen is stabilized.

Moreover, in the liquid ejecting apparatus, the carrier driven roller and the discharge driven roller may be the conductive roller. In this way, the liquid ejecting apparatus can control the electric potential of recording material by means of an existing member. In this way, since the recording material is coupled to the potential difference generating section just before and just after the platen, the electric potential of recording material on the platen is stabilized. Moreover, since the carrier driven roller and the discharge driven roller have simple support structure, the electric coupling to the potential difference generating section is easy.

Moreover, in the liquid ejecting apparatus, all of the carrier driving roller, the carrier driven roller, the discharge driving roller, and the discharge driven roller may be the conductive roller. In this way, it is possible to surely control the electric potential of recording material passing over the platen.

Furthermore, according to the second aspect of the present invention, there is provided a field generating unit mounted on a liquid ejecting apparatus including a liquid ejecting head that has a nozzle plate and ejects liquid from an aperture of the nozzle plate toward a recording material while reciprocating over the recording material and a platen that supports the recording material from a rear face thereof to position the recording material at a position facing the nozzle plate in a direction in which the liquid is ejected. The field generating unit includes: a first electrode being provided on the platen side between the liquid ejecting head and the platen; a second electrode being provided on the liquid ejecting head side between the liquid ejecting head and the platen; and a potential difference generating section of which one end is connected to the first electrode and the other end is connected to the second electrode and that generates a potential difference between the second electrode and the first electrode. In this way, a generation prevention function of the described above aerosol can be added to the existing liquid ejecting apparatus that did not have such a function at first.

The second electrode may be a conductive nozzle plate, the first electrode may be electrically coupled to the recording material supported on the platen, and the field generating unit may generate an electric field between the nozzle plate and the recording material on the platen to electrically attract liquid ejected from the aperture of the nozzle plate toward the recording material. In this way, a generation prevention function of the described above aerosol can be added to the existing liquid ejecting apparatus that did not have such a function at first.

Moreover, in the liquid ejecting apparatus on which the field generating unit is mounted, the first electrode may be mounted on the platen, and be electrically coupled to the recording material supported on the platen.

Moreover, the liquid ejecting apparatus on which the field generating unit is mounted may further include: a carrying portion that includes a rotationally driven carrier driving roller and a carrier driven roller rotated with the rotation of the carrier driving roller while pressing the recording material on the carrier driving roller and sends the recording material onto the platen; and a discharging portion that includes a rotationally driven discharge driving roller and a discharge driven roller rotated with the rotation of the discharge driving roller while pressing the recording material on the discharge driving roller and sends away the recording material from the top of the platen, at least one of the carrier driving roller, the carrier driven roller, the discharge driving roller, and the discharge driven roller may be a conductive roller formed of a conductive material, and the conductive roller may be electrically coupled to the recording material as the first electrode. In this way, a contamination prevention function by the described above aerosol can be added to the existing liquid ejecting apparatus that did not have such a function at first.

Moreover, according to the third aspect of the present invention, there is provided a recording apparatus including a recording head that has a nozzle plate and discharges ink from an aperture of the nozzle plate toward a recording material while reciprocating over the recording material and a platen that supports the recording material from a rear face thereof to position the recording material at a position facing the nozzle plate in a direction in which the ink is discharged. The recording apparatus includes: a first electrode being provided on the platen side between the liquid ejecting head and the platen; a second electrode being provided on the liquid ejecting head side between the liquid ejecting head and the platen; and a potential difference generating section of which one end is connected to the first electrode and the other end is connected to the second electrode and that generates a potential difference between the second electrode and the first electrode. In this way, the recording apparatus can prevent the generation of an aerosol.

Moreover, the second electrode may be a conductive nozzle plate, the first electrode may be electrically coupled to the recording material supported on the platen, and the recording apparatus may generate an electric field between the nozzle plate and the recording material on the platen to electrically attract ink ejecting from the aperture of the nozzle plate toward the recording material.

Moreover, in the recording apparatus, the first electrode may be mounted on the platen, and be electrically coupled to the recording material supported on the platen.

Moreover, the recording apparatus may further include: a carrying portion that includes a rotationally driven carrier driving roller and a carrier driven roller rotated with the rotation of the carrier driving roller while pressing the recording material on the carrier driving roller and sends the recording material onto the platen; and a discharging portion that includes a rotationally driven discharge driving roller and a discharge driven roller rotated with the rotation of the discharge driving roller while pressing the recording material on the discharge driving roller and sends away the recording material from the top of the platen, at least one of the carrier driving roller, the carrier driven roller, the discharge driving roller, and the discharge driven roller may be a conductive roller formed of a conductive material, and the conductive roller may be electrically coupled to the recording material as the first electrode. In this way, the recording apparatus prevents the generation of an aerosol.

The summary of the invention does not necessarily describe all necessary features of the present invention. The present invention may also be a sub-combination of the features described above.

BRIEF DESCRIPTION OF THE DRAWINGS

The above and other objects and features and advantages of the present invention will become more apparent from the following description of the presently preferred exemplary embodiments of the invention taken in conjunction with the accompanying drawings, in which.

DESCRIPTION OF EXEMPLARY EMBODIMENTS

The embodiments of the invention will now be described based on the preferred embodiments, which do not intend to limit the scope of the present invention, but just exemplify the invention. All of the features and the combinations thereof described in the embodiment are not necessarily essential to the invention.

Figure 1:
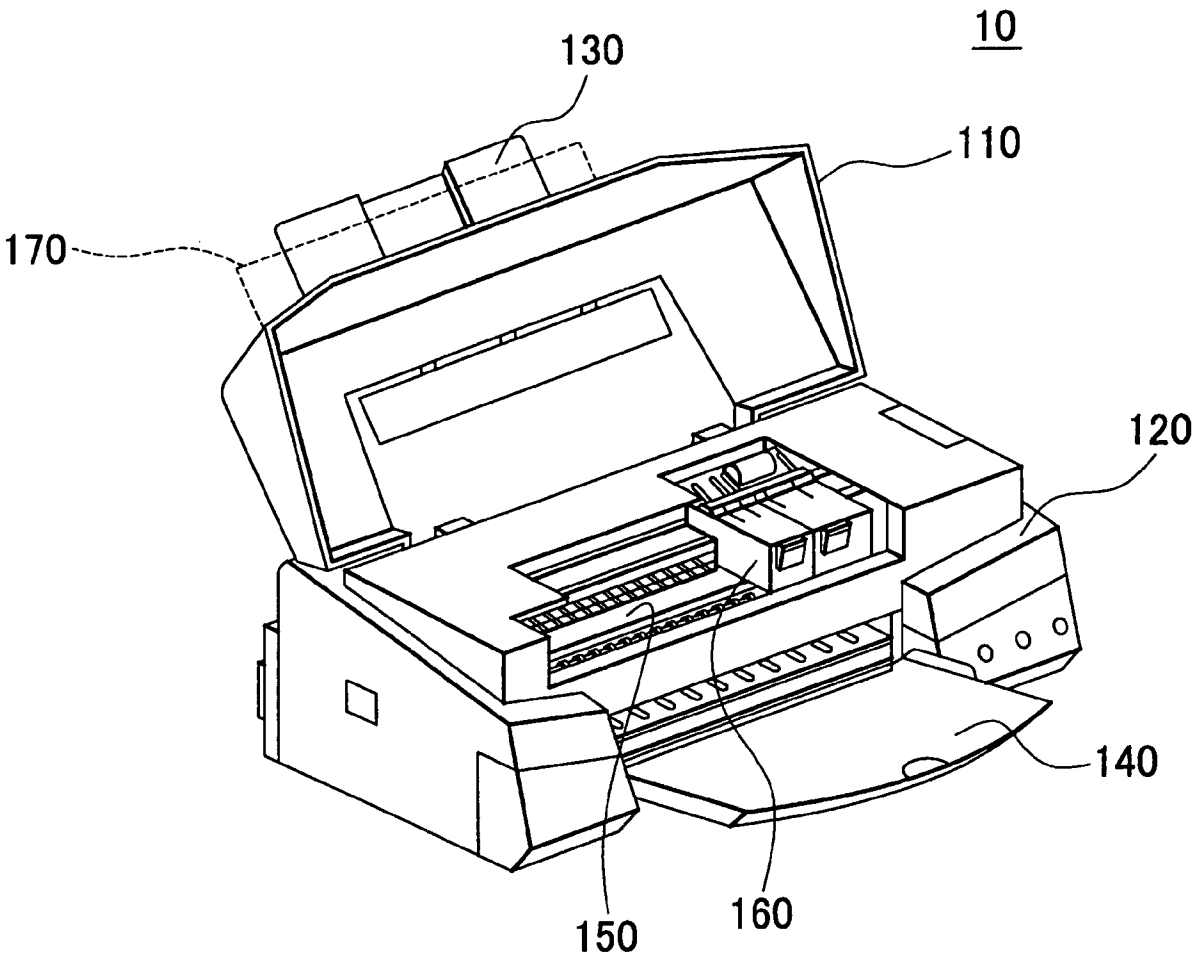
FIG. 1 is a perspective view surveying the whole of an ink-jet type recording apparatus.

FIG. 1 is a perspective view surveying an ink-jet type recording apparatus 10 that is an example of an embodiment of the present invention, and shows a state that a top case 110 as a cover is opened. As shown in the present drawing, the ink-jet type recording apparatus 10 includes a bottom case 120 that is a base of the apparatus, a top case 110 that forms a casing with the bottom case 120, a paper support 130 that is mounted to a rear portion of the bottom case 120, and a discharge tray 140 that is formed on a front face of the bottom case 120. Moreover, the ink-jet type recording apparatus 10 includes a platen 150 that is horizontally arranged in the bottom case 120 and a carriage 160 that is arranged on the upper side of the platen 150, on the inner side of the casing.

In the ink-jet type recording apparatus 10 as described above, a data sheet 170 accommodated on the paper support 130 is sent onto an inside one piece by one piece by means of a feeding portion not shown, and is next sent to the platen 150 by means of a carrying portion not shown. Further, the data sheet is sent to the discharge tray 140 by means of a discharge portion not shown. Moreover, in each of the feeding portion, the carrying portion, and the discharge portion, the data sheet 170 is feed, carried, and discharged while holding the sheet between a rotationally driven driving roller and a driven roller rotated with the rotation of the driving roller.

Moreover, in the ink-jet type recording apparatus 10, the carriage 160 reciprocates in the direction perpendicular to a transportation direction of the data sheet 170 on the upper side of the platen 150. Therefore, since the transportation of the data sheet 170 and the reciprocation of the carriage 160 are performed alternately, the whole top face of the data sheet 170 can be scanned by the carriage 160, and thus the carriage 160 can perform a record operation at an arbitrary area on the data sheet 170.

Figure 2:
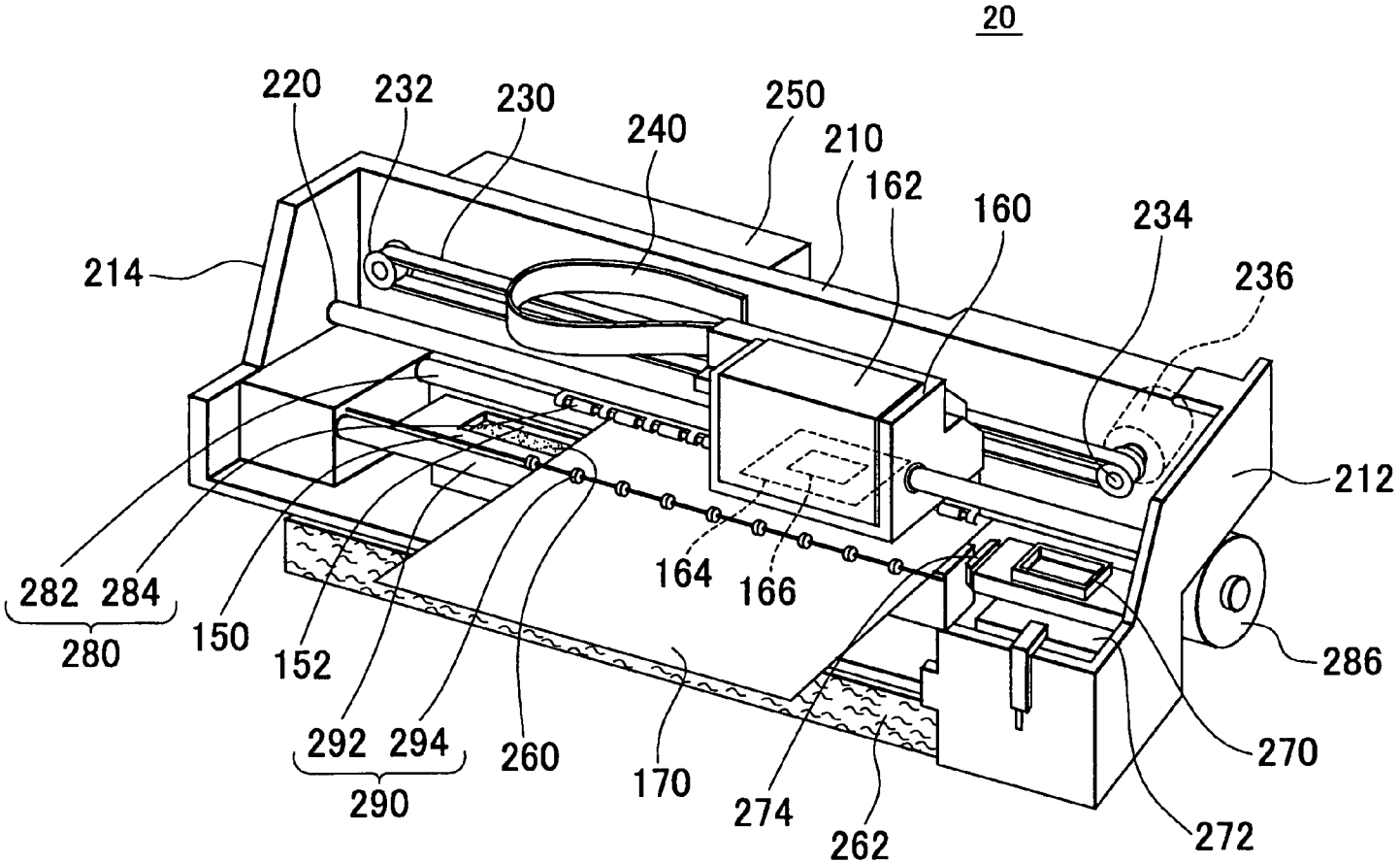
FIG. 2 is a perspective view showing an internal mechanism of an ink-jet type recording apparatus.

FIG. 2 is a perspective view showing an internal mechanism 20 of the ink-jet type recording apparatus 10 shown in FIG. 1 in a state that a frame 210 including side face portions 212 and 214 is pulled out. As shown in the present drawing, the internal mechanism 20 is mainly formed inside an area bounded by the frame 210 that is arranged backward and generally vertically and the pair of side face portions 212 and 214 that are extended from both ends of the frame 210 to the front parallel to each other.

As shown in the present drawing, in the internal mechanism 20, the carriage 160 is supported by a guide shaft 220 penetrating through the carriage. Both ends of the guide shaft 220 are supported by the side face portions 212 and 214, and the guide shaft 220 is arranged parallel and horizontally to the frame 210. Therefore, the carriage 160 can horizontally move along the guide shaft 220.

At the back of the carriage 160, a pair of pulleys 232 and 234 and a timing belt 230 that is hung on the pulleys 232 and 234 are arranged in the front of the frame 210. One pulley 234 is rotationally driven by a carriage motor 236. Moreover, the timing belt 230 is coupled to a rear portion of the carriage 160. Therefore, the carriage 160 can be reciprocated according to an operation of the carriage motor 236.

Moreover, the carriage 160 loads an ink cartridge 162 from the upper side, and also includes a recording head 164 in the lower part. The recording head 164 includes a nozzle plate 166 made of metal including an aperture to discharge ink on the upper face. Therefore, ink is discharged from the carriage 160 toward the lower side. Furthermore, the carriage 160 is coupled with an electronic circuit 250 in the rear of the frame 210 via a tape-shaped multicore cable 240. Since the multicore cable 240 is flexibly bended according to a movement of the carriage 160, the multicore cable 270 does not disturb a reciprocation of the carriage 160.

The platen 150 is arranged on the lower side of an area along which the carriage 160 reciprocates. The platen 150 supports the data sheet 170 passing along a bottom of the carriage 160 from the lower side, in order to hold a distance between the nozzle plate 166 and the data sheet 170 constant. Moreover, a concavity 152 is formed on a top face of the platen 150 and an absorbing member 260 is accommodated in the concavity 152. The absorbing member 260 receives ink discharged from the recording head 164 toward an area on which the data sheet 170 does not exist.

In addition, as the operating time of the ink-jet type recording apparatus 10 elapses, ink adheres to the absorbing member 260. When the data sheet 170 comes in contact with the absorbing member 260 to which ink adheres, a rear face of the data sheet 170 is contaminated with ink. Thus, since a rib-shaped portion is formed on a top face of the platen 150 to lift and support the data sheet 170 from the lower side, an interval between them is maintained to prevent them from being in contact with each other. Specifically, a gap of around 2 to 4 mm is provided between the data sheet 170 and the absorbing member 260. In addition, an interval of about 1 mm is preserved between a surface of the nozzle plate 166 and surfaces of the data sheet 170.

Moreover, since a material of the absorbing member 260 is selected in consideration of absorption velocity on the surface, absorption capacity is limited. Thus, a larger waste liquid absorbing member 262 is arranged on the lower side of the platen 150, and the absorbing member 262 partially comes in contact with the absorbing member 260. In the waste liquid absorbing member 262, the absorption capacity is important, and thus a material having large absorbing power by a capillary phenomenon is selected. Therefore, the waste liquid absorbing member 262 can absorb a large quantity of ink from the absorbing member 260.

Moreover, the absorbing member 260 directly receives ink not attached to the data sheet 170 while being discharged from the nozzle plate 166. At this time, when the absorption velocity of the absorbing member 260 is slow, so-called a milk crown phenomenon occurs due to an impact by which the ink collides with the surface of the absorbing member 260. Minute ink occurs on the periphery of a milk crown, and the ink causes the generation of aerosols. Thus, as the absorbing member 260, a material having high absorption velocity, in other words, high percentage of voids is selected.

Moreover, the absorbing member 260 partially communicates with the waste liquid absorbing member 262 arranged beneath the platen 150 in FIG. 2, in which this configuration is not shown. For this reason, since ink absorbed by the absorbing member 260 is sequentially absorbed by the waste liquid absorbing member 262 having high absorbing power, the absorbing power of the absorbing member 260 lasts over a long term.

On the other hand, the carrier driving roller 282 and the carrier driven roller 284 are arranged at the back of the platen 150 to from the carrying portion 280. The carrier driving roller 282 is rotationally driven by a carrying motor 286 arranged in the rear of the frame 210. Moreover, the carrier driven roller 284 presses the data sheet 170 on the carrier driving roller 282. Therefore, the carrier driven roller 284 is rotated according to the rotation of the carrier driving roller 282, and the data sheet 170 is sent away on the platen 150. Since ink is discharged from the carriage 160 on the platen 150 as described above, an image can be recorded by ink on the data sheet 170.

Moreover, the discharge driving roller 292 and the discharge driven roller 294 are arranged at the front of the platen 150 to form the discharging portion 290. The discharge driving roller 292 is rotationally driven by power distributed from the carrying motor 286. Moreover, the discharge driven roller 294 presses the data sheet 170 passing over the platen 150 on the discharge driving roller 292. Therefore, the discharge driven roller 294 is rotated according to the rotation of the discharge driving roller 292, the data sheet 170 is sent away from the platen 150 to an outside.

Furthermore, in the internal mechanism 20, a cap member 270 is arranged at a lateral side of the platen 400 near the side face portion 212. The cap member 270 can move up and down, and thus ascends and seals a lower face of the nozzle plate 166 when the carriage 160 stops at the home position near the side face portion 212. Moreover, an inside of the cap member 270 is coupled with a pump unit 272. The pump unit 272 can absorb ink attached to the surface of the nozzle plate 166. The ink absorbed by the pump unit 272 is absorbed into the waste liquid absorbing member 262 through a pipe not shown.

Furthermore, a wiping means 274 is arranged between the platen 150 and the cap member 270. When the carriage 160 released from the sealing by the cap member 270 passes above the wiping means 274, the wiping means 274 wipes out the lower part of the nozzle plate 166 to clean it.

Figure 3:
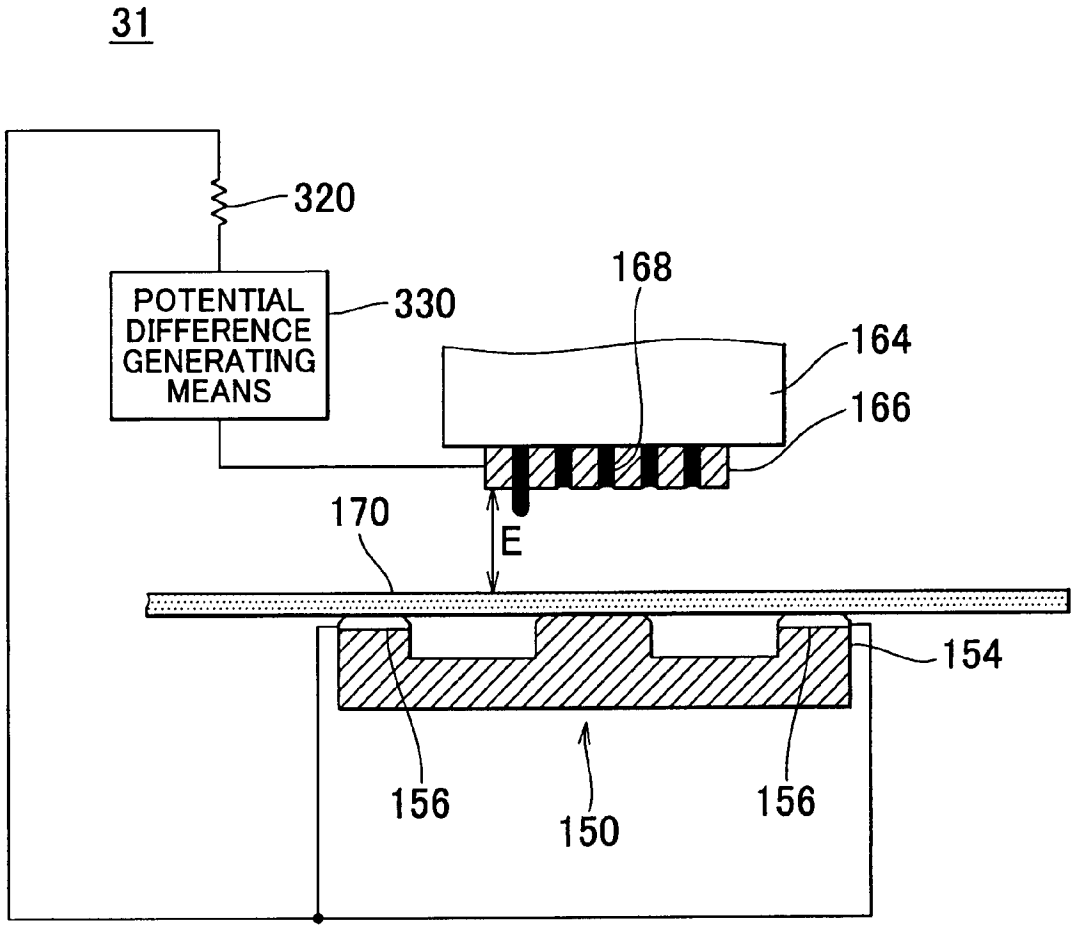
FIG. 3 is a sectional view showing a structure of an aerosol generation preventing mechanism according to an embodiment.

FIG. 3 is a sectional view typically showing a structure of an aerosol generation preventing mechanism 31 formed in the ink-jet type recording apparatus 10 as described above. As shown in the present drawing, the platen 150 includes a rib portion 154 protruded upward, and positions the data sheet 170 up and down by supporting the rib portion from the lower part on the upper end. Furthermore, a rib electrode 156 made of metal is mounted on an upper end of the rib portion 154. The rib electrode 156 is electrically connected to a positive pole of the potential difference generating means 330 via a short protecting resistor 320 and also contacts a lower face of the data sheet 170. Therefore, when the potential difference generating means 330 operates, the data sheet 170 has the same electric potential as that of the positive pole of the potential difference generating means 330.

On the other hand, the nozzle plate 166 is connected to a negative pole of the potential difference generating means 330. Therefore, a potential difference according to the potential difference generated from the potential difference generating means 330 is generated between the data sheet 170 and the nozzle plate 166, and electric field E according to the potential difference is formed between both. In addition, the potential difference generating means 330 is a constant voltage generating circuit, and adjusts an output so that the potential difference becomes an original value when the potential difference between the nozzle plate 166 and the rib electrode 156 is changed by some kind of cause. In this manner, the rib electrode 156 forms a potential controlling electrode for the data sheet 170.

In the above aerosol generation preventing mechanism 31, the rib electrode 156 can be formed of metal having high resistance to wear and high conductivity such as stainless steel, iron plated with nickel, duralumin, iron including chrome or molybdenum, tungsten, titanium, alloy including titanium. Moreover, the rib electrode 156 can be integrated with the platen 150 by embedding, attaching, and two-body shaping using a material such as carbon, metal, conductive polymer. Furthermore, the rib electrode 156 can be formed by partially depositing an amorphous semiconductor such as selenium and silicon or metal on the rib portion 154.

Figure 4:
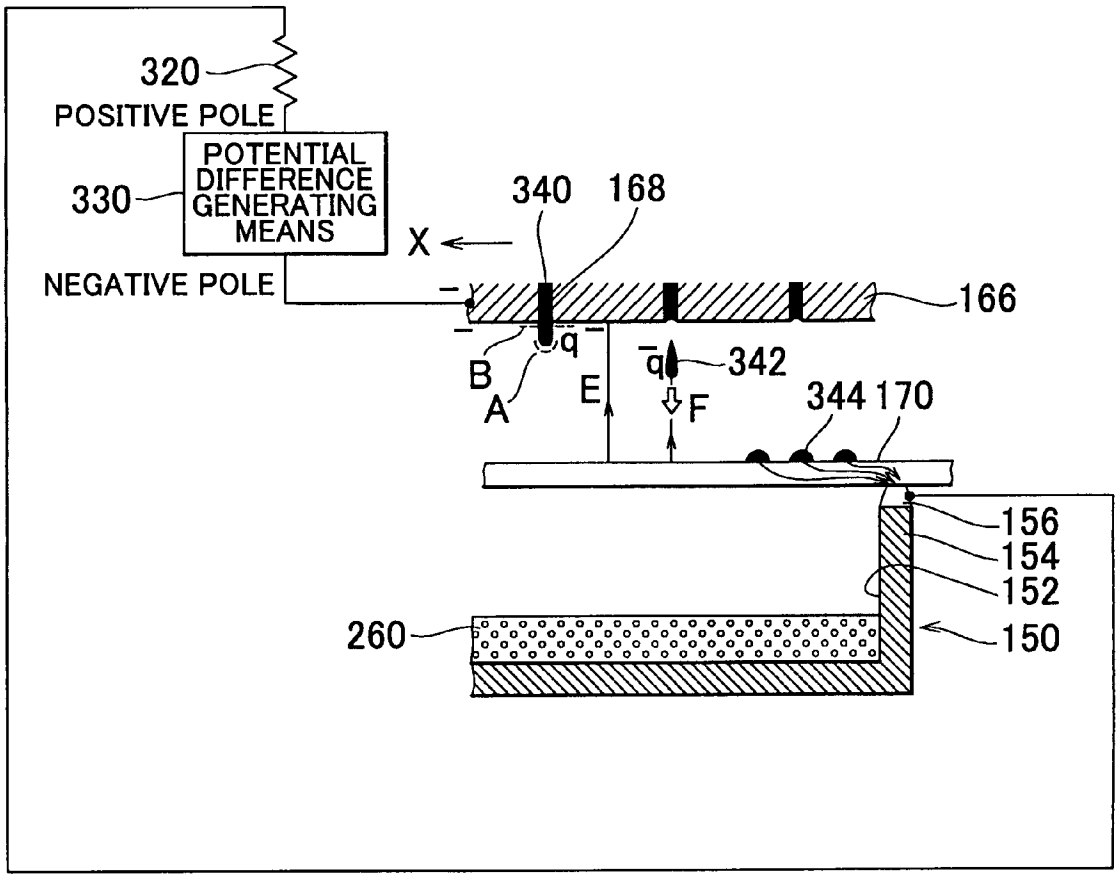
FIG. 4 is a schematic block diagram explaining an operation of an aerosol generation preventing mechanism.

FIG. 4 is a schematic block diagram explaining an operation of the above aerosol generation preventing mechanism 31. As shown in the present drawing, a plurality of apertures 168 for discharging ink is formed in the nozzle plate 166. Moreover, as shown with an arrow X in the present drawing, the nozzle plate 166 moves from right to left on the present drawing with the movement of the carriage 160.

Meanwhile, ink pushed from the aperture 168 of the nozzle plate 166 forms an ink pillar 340 drooping from the nozzle plate 166 at the moment immediately before the ink becomes an ink drop 342. At this time, electric charges are accumulated by so-called lightning conductor effect between a leading end A of the ink pillar 340 and an area B adjacent to the ink pillar 340 on a lower face of the nozzle plate 166.

That is, the above lightning conductor effect means that the area B on the surface of the nozzle plate 166 surrounded with a conical shape including a range of a vertex angle from 50° to 60° with the leading end A (a bottom end in the present drawing) of the ink pillar 340 at the top contributes to the charge of the ink drop 342. By this lightning conductor effect, the ink drop 342 has an electric charge q larger than that corresponding to a horizontal cross-section area of the ink pillar 340 and equal to that of the nozzle plate 166.

On the other hand, in the aerosol generation preventing mechanism 31, an electric field E is formed between the nozzle plate 166 and the rib electrode 156 and the data sheet 170. As described above, since the ink drop 342 is charged with an electric charge q, the ink drop 342 obtains kinetic energy by a Coulomb force F (qE) from the electric field E, and thus moves on the lower side without deceleration to finally arrive at the data sheet 170. In this manner, in the electric field E, the generation of aerosols is prevented because the ink drop 344 surely arrives at the data sheet 170.

In addition, in the ink-jet type recording apparatus 10 as shown in FIGS. 1 to 4, in order to make a Coulomb force act on the ink drop 342 to prevent the generation of aerosols, it is desirable to set field intensity of the electric field E to the order of 100 kV/m. Moreover, when a potential difference is formed using the nozzle plate 166 as one electrode in order to form such an electric field, an electric charge accumulated in a droplet discharged from the nozzle plate 166 is about 4*10-14Q.

On the other hand, when the data sheet 170 is general premium grade paper or paper made by coating porous silica on the premium grade paper, the volume resistivity is about 107 to 1013 Ωcm. When ink having electrical conductivity penetrates such a data sheet 170, the volume resistivity deteriorates to 105 to 107 Ωcm. Moreover, surface resistivity of the data sheet 170 to which the ink adheres becomes about 103 to 107 Ω/square.

Therefore, when the rib electrode 156 formed of metal having sufficiently high electrical conductivity touches the data sheet 170 to be connected to the potential difference generating means 330, electric potential of the data sheet 170 can be controlled so as to be identical with an output voltage from the potential difference generating means 330 by going through the data sheet 170 itself and the ink on the data sheet 170. Moreover, since electric charges in the ink drop 342 is discharged through the data sheet 170 and the ink 344 already attached to the sheet when the charged ink drop 342 is deposited on the data sheet 170, electric potential on the data sheet 170 does not vary.

Moreover, in the above embodiment, the rib electrode 156 is connected to a positive pole side of the potential difference generating means 330 and the nozzle plate 166 is connected to a negative pole side of the potential difference generating means 330. However, although all polarities are reversely connected, a similar function is realized. Moreover, it is possible to simplify wiring within the aerosol generation preventing mechanism 31 by setting electric potential of one end of the potential difference generating means 330 to ground potential.

Figure 5:
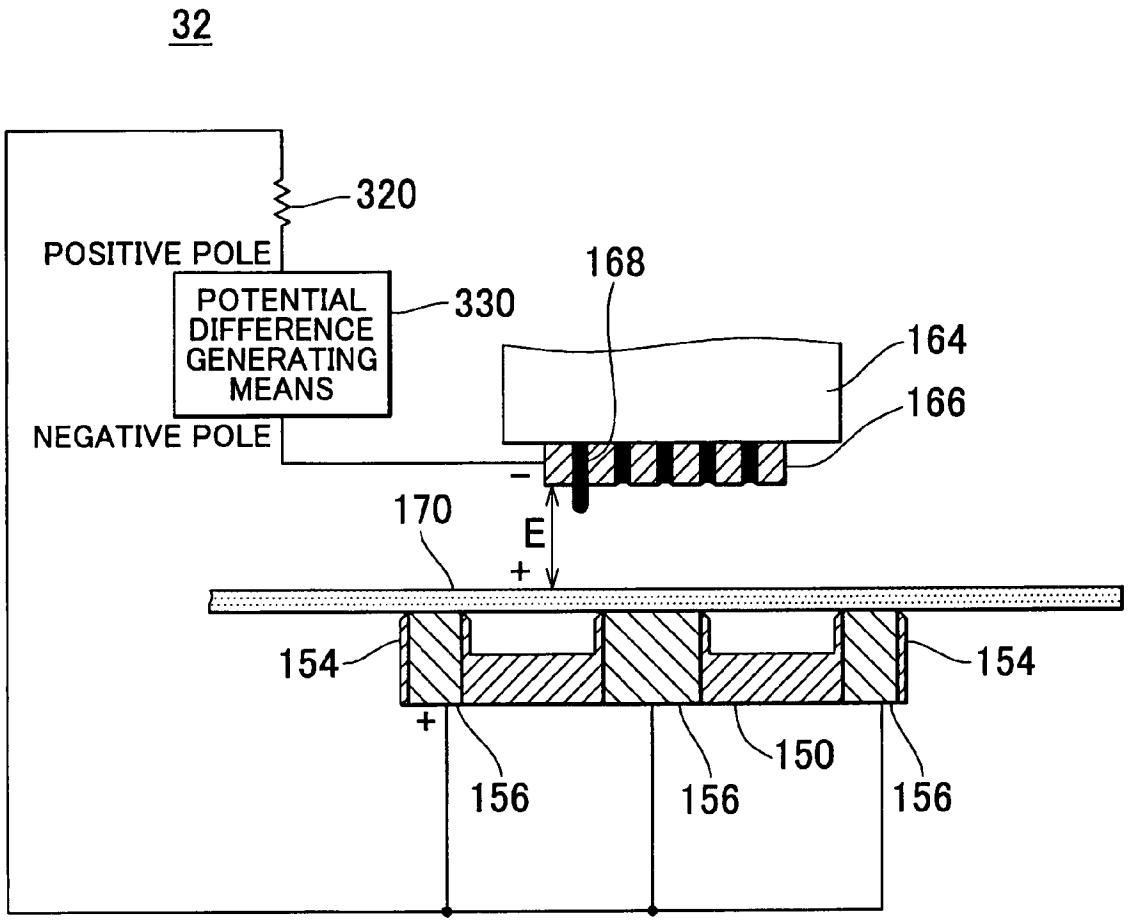
FIG. 5 is a sectional view showing a structure of an aerosol generation preventing mechanism according to another embodiment.

FIG. 5 is a sectional view typically showing a structure of an aerosol generation preventing mechanism 32 according to another embodiment. In addition, in FIG. 5, the same reference numbers are put on components common to the other drawings and the description is omitted.

As shown in the present drawing, a structure of the aerosol generation preventing mechanism 32 according to this embodiment has a characteristic peculiar to the shape of the rib electrode 156. That is to say, this rib electrode 156 penetrates through the rib portion 154 of the platen 150 up and down to expose the lower end on the lower face of the platen 150. Therefore, wiring from the rib electrode 156 and the potential difference generating means 330 can be coupled in the lower part of the platen 150. According to such a structure, since wiring is not shown to a user even if a function as the rib electrode 156 and the aerosol generation preventing mechanism 32 equals to that of the aerosol generation preventing mechanism 31 shown in FIG. 3, safety and merchantability are high.

Figure 6:
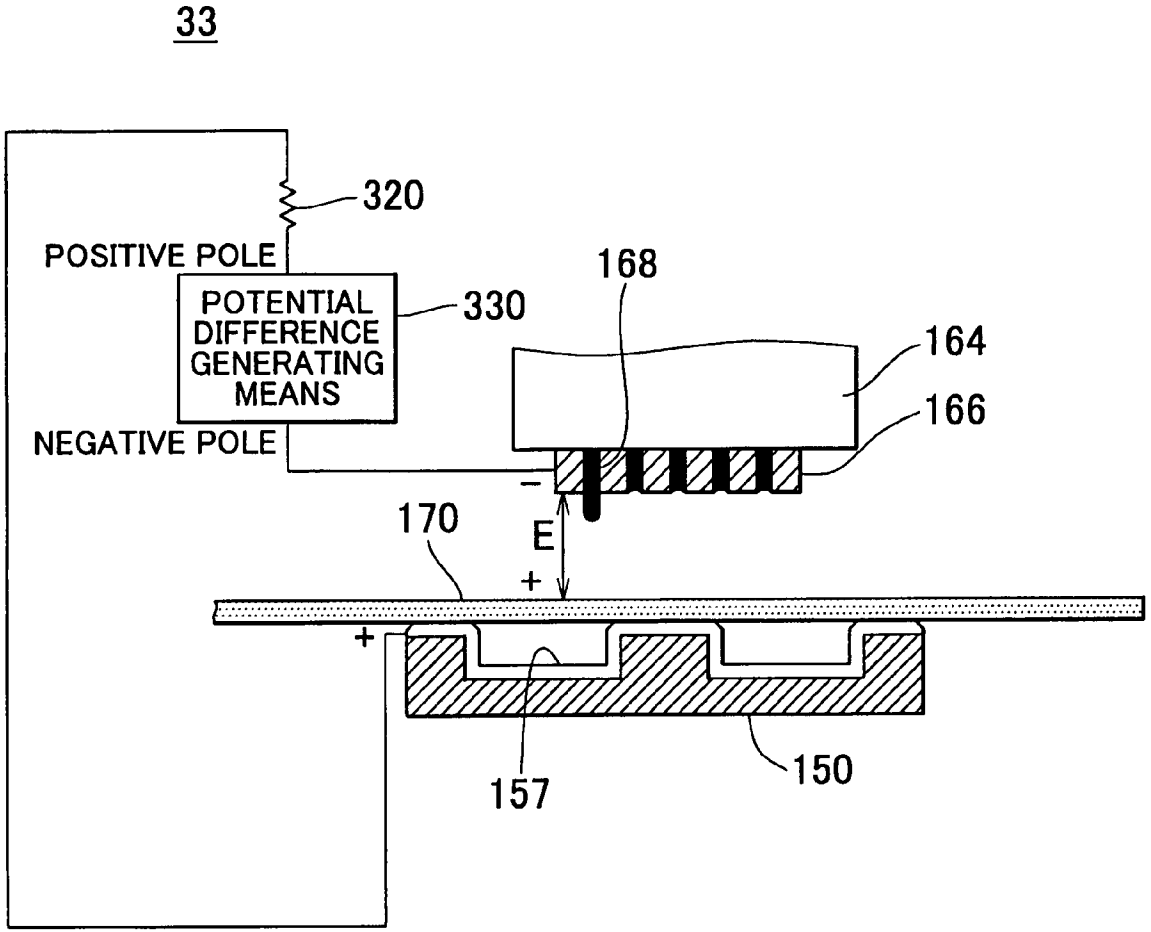
FIG. 6 is a sectional view showing a structure of another aerosol generation preventing mechanism.

FIG. 6 is a sectional view typically showing a structure of an aerosol generation preventing mechanism 33 according to further another embodiment. In addition, in FIG. 6, the same reference numbers are put on components common to the other drawings and the description is omitted.

As shown in the present drawing, a structure of the aerosol generation preventing mechanism 33 according to this embodiment has a characteristic peculiar to the shape of the rib electrode 156. That is to say, this rib electrode 156 is formed of an electrically conducting layer 157 formed on the whole surface of the platen 150. Such an electrically conducting layer 157 can be formed by two-body shaping with the platen 150 in addition to application or vapor deposition to the platen 150. According to such a structure, although a function as the electrically conducting layer 157 as a potential controlling electrode and the aerosol generation preventing mechanism 33 equals to that of the aerosol generation preventing mechanism 31 shown in FIG. 3, since a contact area between the data sheet 170 and the rib electrode 156 becomes wide to the maximum, both stably have the same electric potential. Therefore, an operation as the aerosol generation preventing mechanism 32 is also stable.

Figure 7:
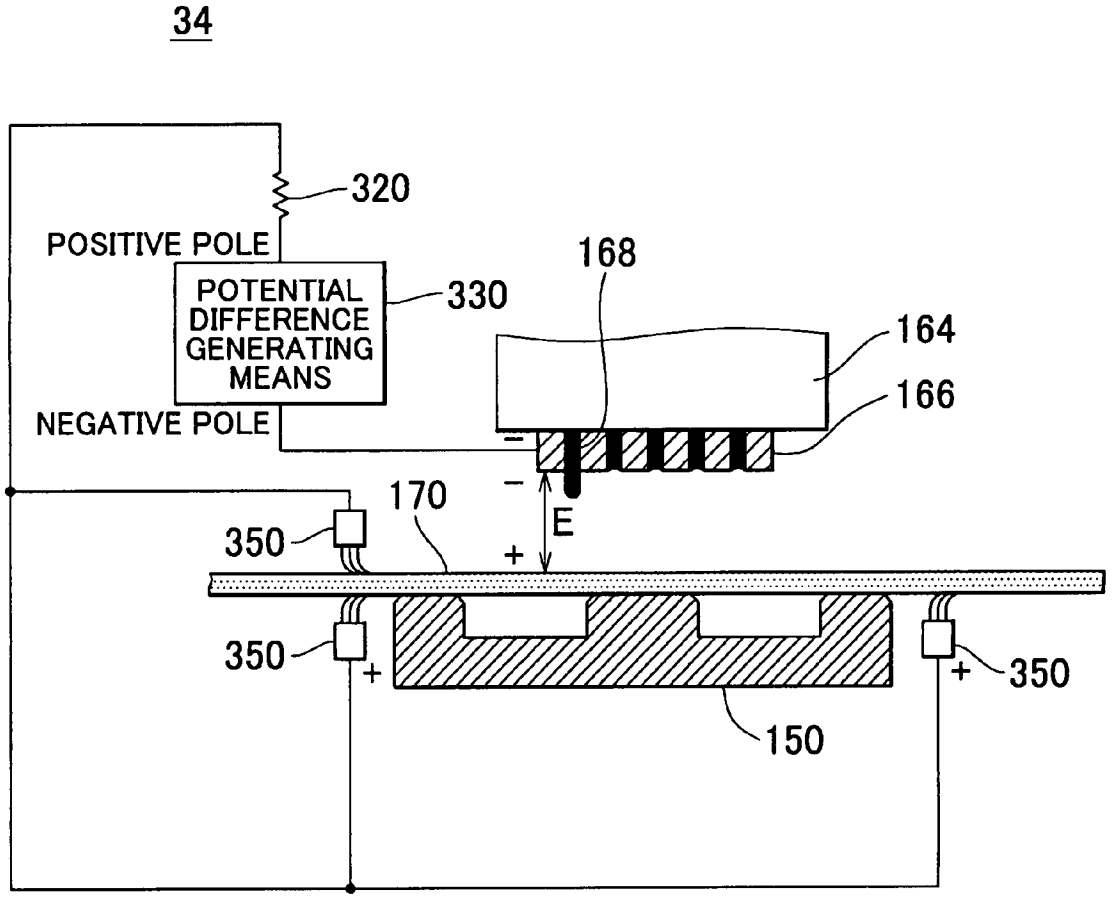
FIG. 7 is a sectional view showing a structure of further another aerosol generation preventing mechanism.

FIG. 7 is a sectional view typically showing a structure of an aerosol generation preventing mechanism 34 according to further another embodiment. In addition, in FIG. 7, the same reference numbers are put on components common to the other drawings and the description is omitted.

In the embodiment shown in the present drawing, a plurality of conductive brushes 350 is arranged closest to the platen 150 as a means for obtaining electrical connection to the data sheet 170. Each conductive brush 350 is formed of a member having electrical conductivity and elasticity, and one end thereof is electrically connected to the potential difference generating means 330. Moreover, the other end of the conductive brush 350 contacts the data sheet 170 at a plurality of points. That is to say, the conductive brushes 350 are arranged on a surface and a rear face of the data sheet 170 immediately before the platen 150 in a transportation direction of the data sheet 170, and respectively contact the surface and the rear face of the data sheet 170. Moreover, the conductive brush 350 is arranged on the rear face side of the data sheet 170 immediately after the platen 150, and contacts the rear face of the data sheet 170.

Such a configuration should introduce a dedicated member referred to as the conductive brush 350. However, since the conductive brush 350 is a dedicated part for obtaining electrical connection, arrangement can be freely selected. Therefore, the conductive brush can be arranged closest to the platen 150, the nozzle plate 166, and so on related to aerosol collection, and thus electric potential of the data sheet 170 can be efficiently controlled. In addition, the conductive brush 350 can be formed of resin fiber containing carbon or metal powder in addition to a metal wire rod such as stainless steel.

Figure 8:
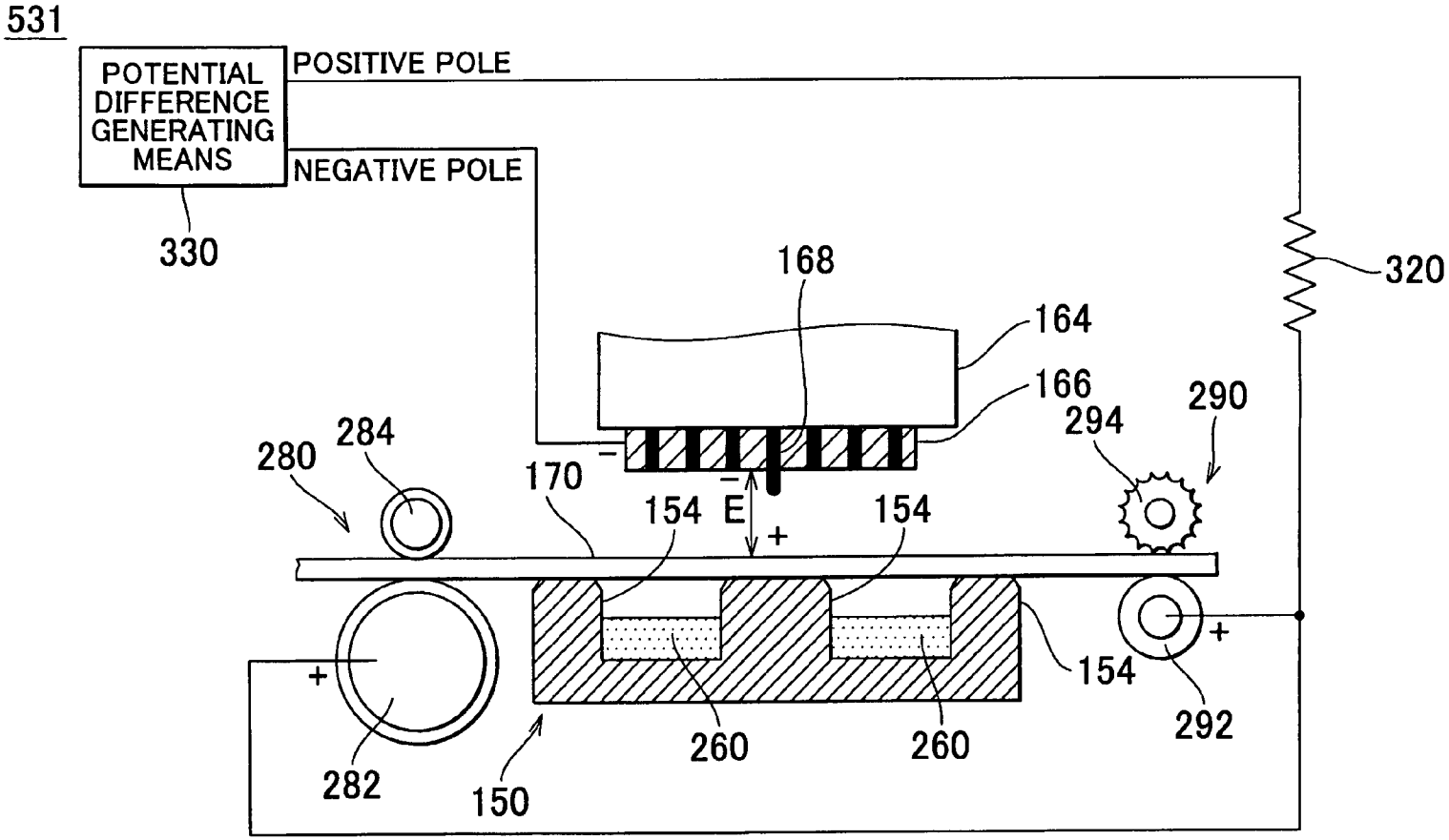
FIG. 8 is a sectional view showing a structure of further another aerosol generation preventing mechanism.

FIG. 8 is a sectional view typically showing a structure of an aerosol generation preventing mechanism 531 according to further another embodiment. As shown in the present drawing, the platen 150 includes a rib portion 154 protruding upward, and supports the data sheet 170 on the upper end from the lower part to position the data sheet 170 up and down. Here, in order to attach ink discharged from the recording head 164 to the data sheet 170, it is necessary to carry the data sheet 170 from the outside to feed it onto the platen 150. Moreover, the data sheet 170 to which ink adheres on the platen 150 is sent away from the top of the platen 150 to the outside to be discharged. Transportation and discharge of the data sheet 170 are performed by a carrying portion 280 and a discharging portion 290 each including a pair of rollers.

The carrying portion 280 includes a carrier driving roller 282 contacting the lower face of the data sheet 170 and a carrier driven roller 284 contacting the upper face of the data sheet 170 to press it on the carrier driving roller 282. Here, the carrier driving roller 282 is rotationally driven by a carrying motor 286. On the other hand, the carrier driven roller 284 does not have driving force, and is rotated with the rotation of the carrier driving roller 282 while pressing the data sheet 170 on the carrier driving roller 282. These carrier driving roller 282 and carrier driven roller 284 continues to touch the data sheet 170 from the leading end to the rear end of the data sheet 170 during carrying the sheet. Therefore, the carrier driving roller 282 is formed of a conductive material and is also connected to the potential difference generating means 330 so that electric potential of the data sheet 170 can be controlled via the carrying portion 280.

The discharging portion 290 includes a discharge driving roller 292 contacting the lower face of the data sheet 170 and a discharge driven roller 294 contacting the upper face of the data sheet 170 to press it on the discharge driving roller 292. Here, the discharge driving roller 292 is rotationally driven by the carrying motor 286 via transfer mechanism not shown. On the other hand, the discharge driven roller 294 does not have driving force, and is rotated with the rotation of the discharge driving roller 292 while pressing the data sheet 170 on the discharge driving roller 292. These discharge driving roller 292 and discharge driven roller 294 continues to touch the data sheet 170 from the leading end to the rear end of the data sheet 170 during carrying the sheet. Therefore, the discharge driving roller 292 is formed of a conductive material and is connected to the potential difference generating means 330 so that electric potential of the data sheet 170 can be controlled via the discharging portion 290.

Furthermore, both of the discharge driving roller 292 and the discharge driven roller 294 are formed of a conductive material and is electrically connected to the potential difference generating means 330, so that electric potential of the data sheet 170 can be continuously controlled from when the leading end of the data sheet 170 comes to the platen 150 to when the rear end passes over the platen 150. In this embodiment, the carrier driven roller 284 and the discharge driven roller 294 are together connected to a positive pole of the potential difference generating means 330 via a short protecting resistor 320. On the other hand, the nozzle plate 166 is connected to a negative pole of the potential difference generating means 330. Therefore, in the ink-jet type recording apparatus 10, electric field E is formed between the nozzle plate 166 and the data sheet 170.

In addition, materials of these carrier driving roller 282 and discharge driving roller 292 can include metal material having rigidity and electrical conductivity such as iron, iron plated with nickel, stainless steel. Furthermore, in order to prevent the carrier driving roller 282 from sliding on the data sheet 170, it is preferable to attach alumina grains to a surface of the carrier driving roller to improve frictional force of the surface. Moreover, the surface may be coated with conductive rubber instead of attaching alumina grains to the surface.

Figure 9:
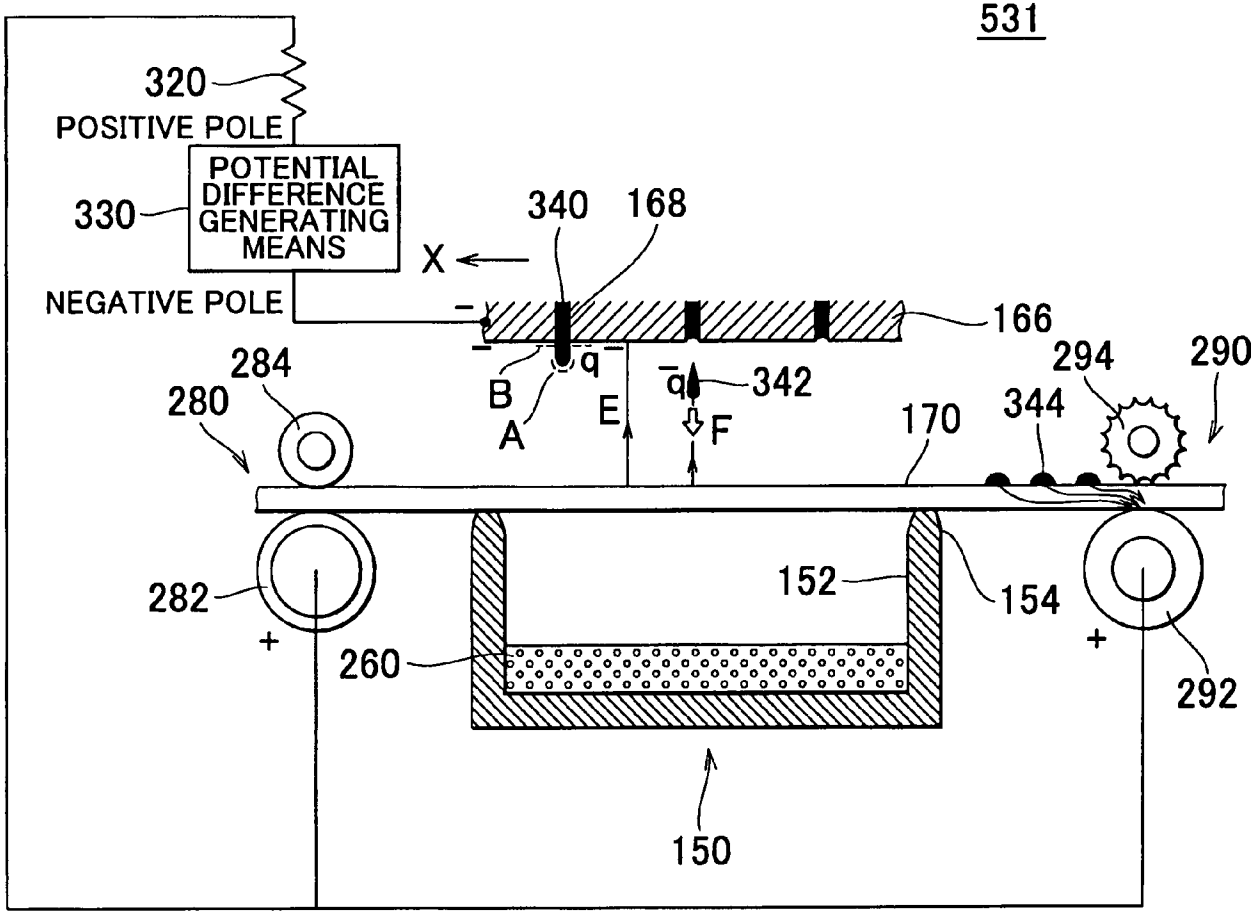
FIG. 9 is a schematic block diagram explaining an operation of an aerosol generation preventing mechanism.

FIG. 9 is a schematic block diagram explaining an operation of the aerosol generation preventing mechanism 531. As shown in the present drawing, a plurality of apertures 168 for discharging ink is formed in the nozzle plate 166. Moreover, as shown with an arrow X in the drawing, the nozzle plate 166 moves from right toward left on the drawing with the movement of the carriage 160.

When the data sheet 170 exists right under the nozzle plate 166, the ink drop 342 is discharged from the aperture 168 of the nozzle plate 166 toward the data sheet 170. Kinetic energy given to the ink drop 342 after being discharged from the aperture 168 is rapidly lost by viscous resistance of an atmosphere, and a part of the ink drops 342 is perfectly lost far before arriving at the data sheet 170. Moreover, since the mass of the ink drop 342 is extremely small, a falling motion by acceleration of gravity and a viscous resistance force nearly balances, and thus fall velocity of the ink drop 342 becomes extremely late. In this way, the ink drop 342 floating beneath the nozzle plate 166 becomes an aerosol.

Meanwhile, ink pushed from the aperture 168 of the nozzle plate 166 becomes the ink pillar 340 drooping from the nozzle plate 166 at the moment immediately before being the ink drop 342. At this time, electric charges are accumulated by so-called lightning conductor effect between a leading end A of the ink pillar 340 and an area B adjacent to the ink pillar 340 on the lower face of the nozzle plate 166.

That is to say, the lightning conductor effect means that the area B on the surface of the nozzle plate 166 surrounded with a conical shape including a range of a vertex angle from 50° to 60° with the leading end A (a bottom end in the present drawing) of the ink pillar 340 at the top contributes to the charge of the ink drop 342. By this lightning conductor effect, the ink drop 342 has an electric charge q larger than that corresponding to a horizontal cross-section area of the ink pillar 340 and equal to that of the nozzle plate 166.

On the other hand, in the aerosol generation preventing mechanism 531, an electric field E is formed between the nozzle plate 166 and the data sheet 170. As described above, since the ink drop 342 is charged with the electric charge q equal to that of the nozzle plate 166, the ink drop 342 obtains kinetic energy by a Coulomb force F (qE) from the electric field E, and thus moves on the lower side without deceleration to finally arrive at the data sheet 170. In this manner, the generation of aerosols is prevented because the ink drop 342 in the electric field E surely arrives at the data sheet 170.

In addition, in the ink-jet type recording apparatus 10 as shown in FIGS. 2 to 9, in order to make a Coulomb force act on the ink drop to prevent the generation of aerosols, it is desirable to set field intensity of the electric field E to the order of 100 kV/m. Moreover, when a potential difference is formed using the nozzle plate as one electrode in order to form such an electric field, an electric charge accumulated in a droplet discharged from the nozzle plate 166 is about $4*10^{-14}$Q.

On the other hand, when the data sheet 170 is general premium grade paper or paper made by coating porous silica on the premium grade paper, the volume resistivity is about $10^7$ to $10^{13}$ Ωcm. When ink having electrical conductivity penetrates such a data sheet 170, the volume resistivity deteriorates to $10^5$ to $10^7$ Ωcm. Moreover, surface resistivity of the data sheet 170 to which the ink adheres becomes about $10^3$ to $10^7$ Ω/square.

Therefore, when the carrier driving roller 282 and the discharge driving roller 292 formed of metal having sufficiently high electrical conductivity touches the data sheet 170 to be connected to the potential difference generating means 330, electric potential of the data sheet 170 can be controlled so as to be identical with an output voltage from the potential difference generating means 330 by going through the data sheet 170 itself and the ink drop 344 on the data sheet 170. Moreover, since electric charges in the ink drop 344 is discharged through the data sheet 170 and the ink attached to the sheet when the charged ink drop 344 is deposited on the data sheet 170, electric potential on the data sheet 170 does not vary.

Moreover, in the above embodiment, the data sheet 170 side is connected to a positive pole side of the potential difference generating means 330 and the nozzle plate 166 is connected to a negative pole side of the potential difference generating means 330. However, although all polarities are reversely connected, a similar function is realized. Moreover, it is possible to simplify wiring within the aerosol generation preventing mechanism 531 by setting electric potential of one end of the potential difference generating means 330 to ground potential.

Figure 10:
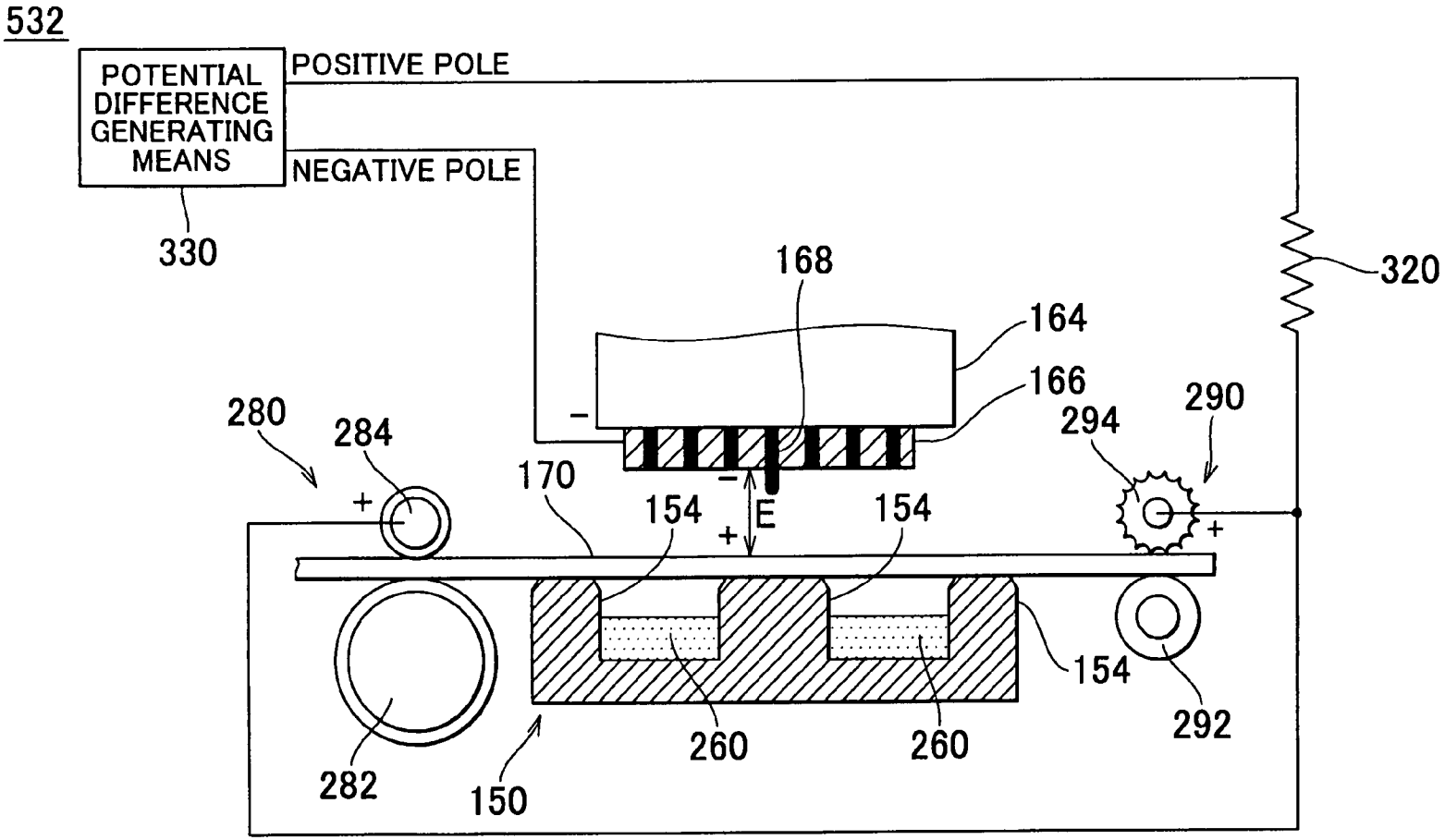
FIG. 10 is a sectional view showing a structure of an aerosol generation preventing mechanism according to another embodiment.

FIG. 10 is a sectional view typically showing a structure of an aerosol generation preventing mechanism 532 according to further another embodiment. In FIG. 10, the same reference numbers are put on components common to the other drawings and the description is omitted.

As shown in the present drawing, in this embodiment, the carrier driven roller 284 and the discharge driven roller 294 are electrically connected to the potential difference generating means 330 in each of the carrying portion 280 and the discharging portion 290. A function obtained in this way is similar to that of the configuration shown in FIG. 8. However, this embodiment has the following advantage. That is to say, the carrier driving roller 282 and the discharge driving roller 292 are mechanically coupled with rotation transfer mechanism such as a gear group for rotational driving. Therefore, using mechanical contact in the transfer mechanism, they can be electrically connected to the potential difference generating means 330. However, in order to realize this, the whole of the rotation transfer mechanism should be formed of a conductive material. However, this kind of rotation transfer mechanism is formed of gears formed of a resin material in many cases. When this resin material is changed into a metal material, this change causes the increase of manufacturing cost and the increase of operating noises.

In this regard, since the carrier driven roller 284 and the discharge driven roller 294 are only supported to be able to be rotated, a potential difference controlling means can be simply formed when these rollers are formed of a conductive material and a shaft supporting means is electrically connected to the potential difference generating means 330. In addition, materials of the carrier driven roller 284 and the discharge driven roller 294 can include iron, iron plated with nickel, metal having electrical conductivity such as stainless steel, or a resin material containing carbon or metal powder and having electrical conductivity.

Figure 11:
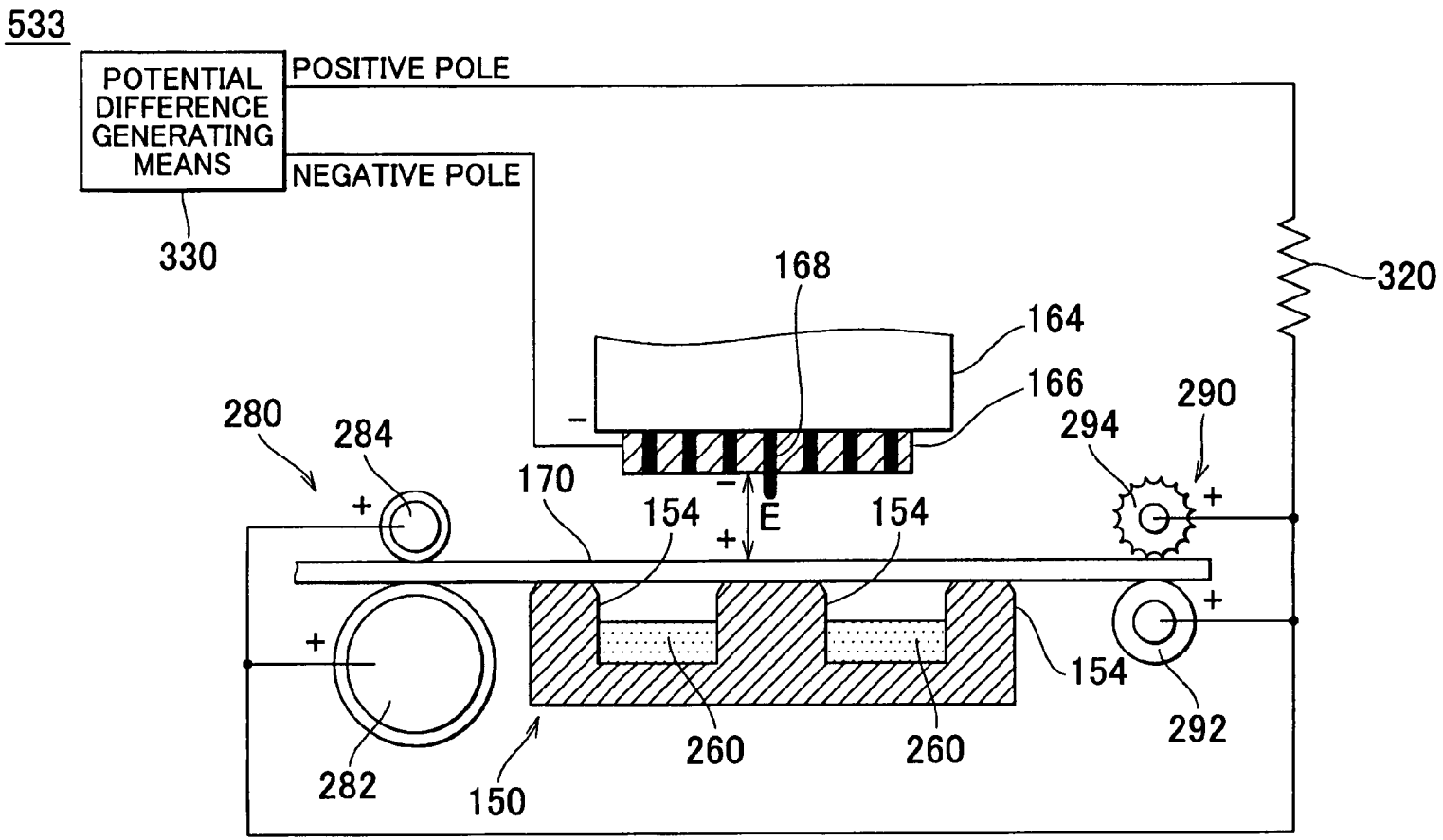
FIG. 11 is a sectional view showing a structure of another aerosol generation preventing mechanism.

FIG. 11 is a sectional view typically showing a structure of an aerosol generation preventing mechanism 533 according to further another embodiment. In FIG. 11, the same reference numbers are put on components common to the other drawings and the description is omitted.

As shown in the present drawing, in this embodiment, all of the carrier driving roller 282, the carrier driven roller 284, the discharge driving roller 292, and the discharge driven roller 294 are formed of a conductive material and electrically connected to the potential difference generating means 330 in each of the carrying portion 280 and the discharging portion 290. A function obtained in this way is similar to that of the configuration shown in FIGS. 8 and 10. However, this embodiment has the following advantage. That is to say, although each roller touches the data sheet 170, each roller microscopically repeats contact and detachment when really carrying or discharging the data sheet 170. For this reason, focusing attention on single roller, the roller is not stably connected to the data sheet 170. However, since either of rollers touches the data sheet 170 as a whole by increasing the number of rollers having contact with the data sheet 170, electric potential of the data sheet 170 can be stabilized.

As described above in detail, the ink-jet type recording apparatus 10 can actively collect droplets by forming an electric field between the nozzle plate 166 and the data sheet 170 to prevent the generation of aerosols. Moreover, since the data sheet can be coupled with the potential difference generating means 330 via a potential controlling electrode in order to constantly preserve electric potential of the data sheet 170, it is not necessary to perform a complicated control such as an inversion of an applied voltage. Therefore, a liquid ejecting apparatus that does not generate aerosols can be realized with a plain structure. Furthermore, it is possible to realize a function similar to that of the existing liquid ejecting apparatus by providing the apparatus as a configuration of a field generating unit.

In addition, in the above embodiment, a concrete configuration has been described using the ink-jet type recording apparatus 10 as an example. However, the liquid ejecting apparatus can be implemented as a color material injection system in manufacture of a color filter for a liquid crystal display, an electrode formation apparatus in manufacture of an organic EL display, FED (a plane emission display), or the like, a sample injection head used in manufacture of a biochip, a sample injection head as a precise pipette, an apparatus that pictures a picture and a character on artificial nails, and so on, and further the liquid ejecting apparatus is not limited to them.

Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

What is claimed is:

1. A liquid ejecting apparatus comprising a liquid ejecting head that has a nozzle plate and ejects liquid from an aperture of the nozzle plate toward a recording material while reciprocating over the recording material and a platen that supports the recording material from a rear face thereof to position the recording material at a position facing the nozzle plate in a direction in which the liquid is ejected, the liquid ejecting apparatus comprising:

a first electrode being provided on the platen side between the liquid ejecting head and the platen;

a second electrode being provided on the liquid ejecting head side between the liquid ejecting head and the platen; and a potential difference generating section of which one end is connected to the first electrode and the other end is connected to the second electrode and that generates a potential difference between the second electrode and the first electrode, wherein the second electrode is a conductive nozzle plate, the first electrode is electrically coupled to the recording material supported on the platen, the liquid ejecting apparatus generates an electric field between the nozzle plate and the recording material on the platen to electrically attract liquid ejected from the aperture of the nozzle plate toward the recording material, the first electrode is mounted on the platen, and is electrically coupled to the recording material supported on the platen, and the first electrode comprises a conductive member mounted through the platen in a direction in which the liquid is ejected, and one end of the first electrode is in contact with the recording material and the other end is electrically connected to the potential difference generating section.

2. The liquid ejecting apparatus as claimed in claim 1, wherein the potential difference generating section constantly keeps a potential difference between the second electrode and the first electrode.

3. The liquid ejecting apparatus as claimed in claim 1, wherein the conductive member of the first electrode is mounted on a part in the platen abutting on the rear face of the recording material.

4. A liquid ejecting apparatus comprising a liquid ejecting head that has a nozzle plate and ejects liquid from an aperture of the nozzle plate toward a recording material while reciprocating over the recording material and a platen that supports the recording material from a rear face thereof to position the recording material at a position facing the nozzle plate in a direction in which the liquid is ejected, the liquid ejecting apparatus comprising:

a first electrode being provided on the platen side between the liquid ejecting head and the platen;

a second electrode being provided on the liquid ejecting head side between the liquid ejecting head and the platen; and a potential difference generating section of which one end is connected to the first electrode and the other end is connected to the second electrode and that generates a potential difference between the second electrode and the first electrode, wherein the second electrode is a conductive nozzle plate, the first electrode is electrically coupled to the recording material supported on the platen, the liquid ejecting apparatus generates an electric field between the nozzle plate and the recording material on the platen to electrically attract liquid ejected from the aperture of the nozzle plate toward the recording material, the first electrode is mounted on the platen, and is electrically coupled to the recording material supported on the platen, and the first electrode comprises a conductive member being in contact with the recording material on at least one side of just before and just after the platen on a carrying path of the recording material.

5. The liquid ejecting apparatus as claimed in claim 4, wherein the potential difference generating section constantly keeps a potential difference between the second electrode and the first electrode.

6. The liquid ejecting apparatus as claimed in claim 4, wherein the conductive member of the first electrode is mounted on a part in the platen abutting on the rear face of the recording material.

7. A liquid ejecting apparatus comprising a liquid ejecting head that has a nozzle plate and ejects liquid from an aperture of the nozzle plate toward a recording material while reciprocating over the recording material and a platen that supports the recording material from a rear face thereof to position the recording material at a position facing the nozzle plate in a direction in which the liquid is ejected, the liquid ejecting apparatus comprising:

a first electrode being provided on the platen side between the liquid ejecting head and the platen;

a second electrode being provided on the liquid ejecting head side between the liquid ejecting head and the platen;

a potential difference generating section of which one end is connected to the first electrode and the other end is connected to the second electrode and that generates a potential difference between the second electrode and the first electrode;

a carrying portion that comprises a rotationally driven carrier driving roller and a carrier driven roller rotated with the rotation of the carrier driving roller while pressing the recording material on the carrier driving roller and sends the recording material onto the platen; and a discharging portion that comprises a rotationally driven discharge driving roller and a discharge driven roller rotated with the rotation of the discharge driving roller while pressing the recording material on the discharge driving roller and sends away the recording material from the top of the platen, wherein the second electrode is a conductive nozzle plate, the first electrode is electrically coupled to the recording material supported on the platen, the liquid ejecting apparatus generates an electric field between the nozzle plate and the recording material on the platen to electrically attract liquid ejected from the aperture of the nozzle plate toward the recording material, at least one of the carrier driving roller, the carrier driven roller, the discharge driving roller, and the discharge driven roller is a conductive roller formed of a conductive material, and the conductive roller is electrically coupled to the recording material as the first electrode.

8. The liquid ejecting apparatus as claimed in claim 7, wherein the carrier driving roller and the discharge driving roller are the conductive roller.

9. The liquid ejecting apparatus as claimed in claim 7, wherein the carrier driven roller and the discharge driven roller are the conductive roller.

10. The liquid ejecting apparatus as claimed in claim 7, wherein all of the carrier driving roller, the carrier driven roller, the discharge driving roller, and the discharge driven roller are the conductive roller.

11. The liquid ejecting apparatus as claimed in claim 7, wherein the potential difference generating section constantly keeps a potential difference between the second electrode and the first electrode.

12. The liquid ejecting apparatus as claimed in claim 7, wherein the first electrode is mounted on the platen, and is electrically coupled to the recording material supported on the platen.

13. The liquid ejecting apparatus as claimed in claim 12, wherein the first electrode comprises a conductive member mounted on a part in the platen abutting on the rear face of the recording material.

14. A liquid ejecting apparatus comprising:

a transporting mechanism that transports a recording material in a transporting direction;

a liquid ejecting head that has a conductive nozzle plate and ejects liquid from an aperture of the nozzle plate toward a recording material;

a platen that supports the recording material from a rear face thereof to position the recording material at a position facing the nozzle plate in a direction in which the liquid is ejected; and an electrode provided on the platen for contacting the recording material supported by the platen, the electrode being provided upstream of the liquid ejecting head in the transportation direction.

15. A liquid ejecting apparatus comprising:

a transporting mechanism that transports a recording material in a transporting direction;

a liquid ejecting head that has a conductive nozzle plate and ejects liquid from an aperture of the nozzle plate toward a recording material;

a platen that supports the recording material from a rear face thereof to position the recording material at a position facing the nozzle plate in a direction in which the liquid is ejected; and an electrode provided on the platen for contacting the recording material supported by the platen, the electrode being provided downstream of the liquid ejecting head in the transportation direction.

* * * * *